US008220299B2

(12) United States Patent
Velandi et al.

(10) Patent No.: US 8,220,299 B2
(45) Date of Patent: Jul. 17, 2012

(54) LOCK ASSEMBLY

(75) Inventors: Sajan Velandi, Blackburn (AU); Andrey Iliuk, Blackburn (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 0 days.

(21) Appl. No.: 12/668,339

(22) PCT Filed: Jul. 2, 2008

(86) PCT No.: PCT/AU2008/000970

§ 371 (c)(1),
(2), (4) Date: Mar. 1, 2010

(87) PCT Pub. No.: WO2009/006676

PCT Pub. Date: Jan. 15, 2009

(65) Prior Publication Data

US 2010/0170311 A1 Jul. 8, 2010

(30) Foreign Application Priority Data

Jul. 11, 2007 (AU) ..... 2007903764

(51) Int. Cl.
*E05B 65/00* (2006.01)
*E05B 35/00* (2006.01)

(52) U.S. Cl. ..... 70/379 R; 70/277; 70/278.1; 70/280; 70/DIG. 35

(58) Field of Classification Search ..... 70/256, 70/257, 277, 278.1, 280–282, 379 R, 380, 70/DIG. 35
See application file for complete search history.

(56) References Cited

U.S. PATENT DOCUMENTS 3,704,608 A * 12/1972 Kloosterziel ..... 70/340
5,265,453 A * 11/1993 Konii et al. ..... 70/379 R
6,147,622 A * 11/2000 Fonea ..... 340/5.2

FOREIGN PATENT DOCUMENTS

EP 0276037 A2 7/1988
EP 0676518 A2 10/1995
GB 2176531 A 12/1986

* cited by examiner

*Primary Examiner* — Suzanne Barrett
*Assistant Examiner* — Ifeolu Adeboyejo
(74) *Attorney, Agent, or Firm* — The Webb Law Firm

(57) ABSTRACT

A lock assembly for use with a powered actuator includes a housing, a first barrel part, a torque transmitting member, a first cam, a drive device and a spring. The housing has at least a first axially extending recess therein. The first barrel part is within the first recess. The torque transmitting member is adapted for abutment and releasable rotational engagement with a key. The first cam is adapted to operate a lock or latch mechanism and for rotational movement with the torque transmitting member. The drive device is adapted for engagement with the powered actuator and releasable engagement with the torque transmitting member. The spring biases the torque transmitting member towards engagement with the drive device.

32 Claims, 5 Drawing Sheets

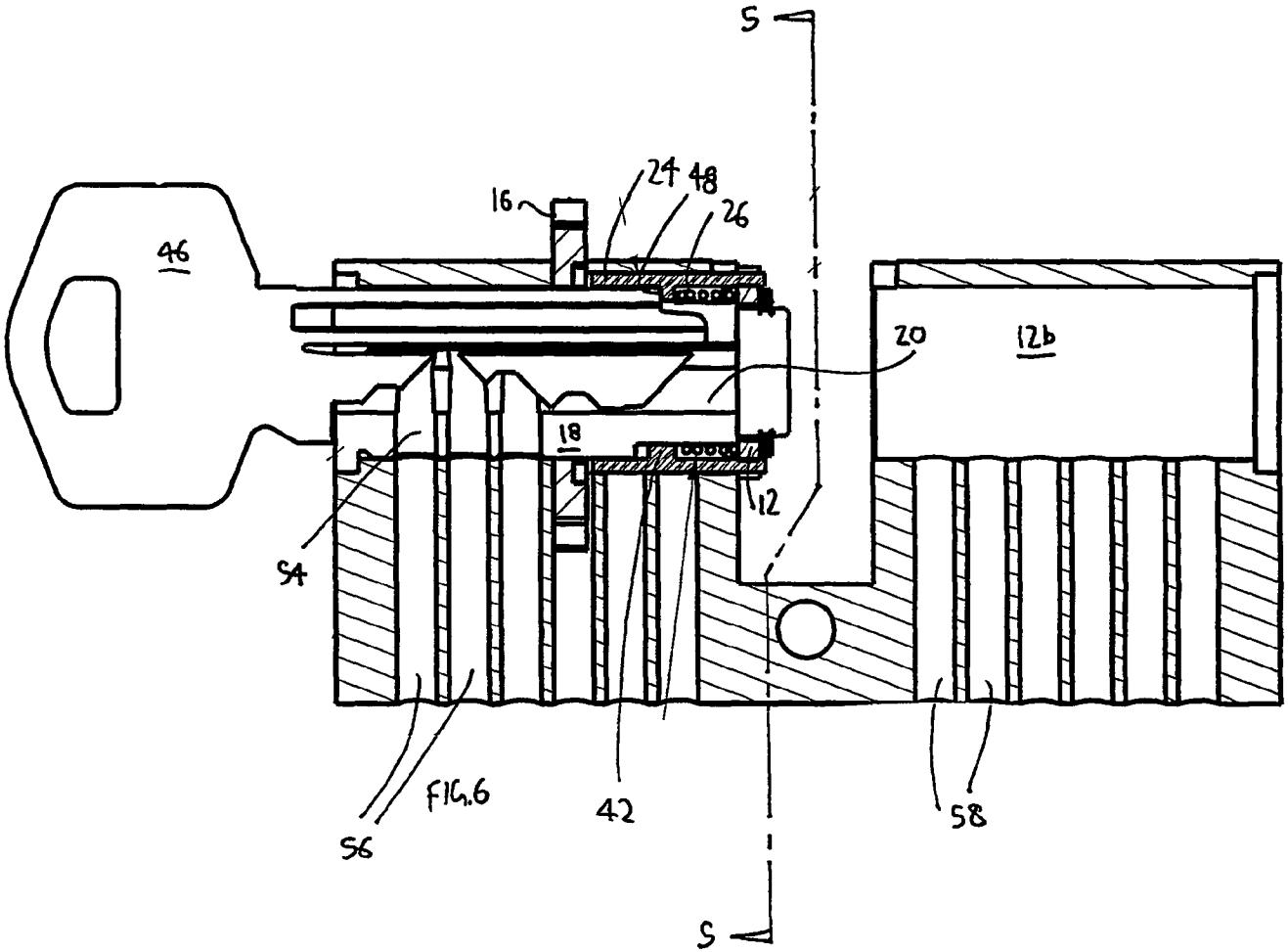
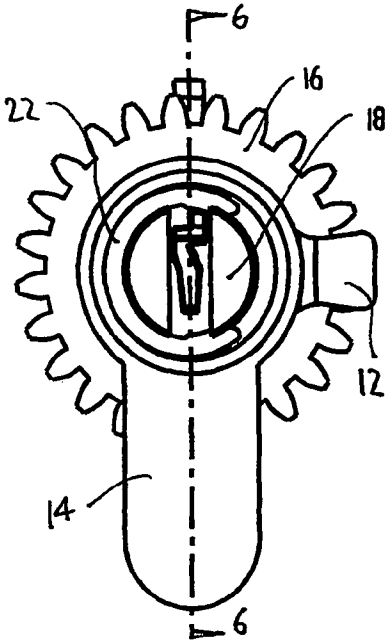
FIG.5

LOCK ASSEMBLY

FIELD OF THE INVENTION

The present invention relates generally to a lock assembly and a method of operating a lock assembly and, more particularly, to a lock assembly suited for use with a powered actuator and a method for operating a powered lock assembly.

BACKGROUND OF THE INVENTION

Lock assemblies suitable for use with powered actuators are known and generally comprise a lock housing with two lock barrels therein. The lock assemblies are configured with one barrel able only to be manually driven by a key and the other barrel able only to be driven by the powered actuator. The lock assemblies are normally installed with the power driven barrel positioned on the outward side of a door and the key driven barrel positioned on the inward side of the door.

A disadvantage of this arrangement is that, if the powered barrel is damaged, for example by vandalism or by unauthorised attempts to open the door, then any authorised person subsequently attempting to open the door will be locked out.

Known lock arrangements of this type are also unsuitable for installation with the key driven barrel on the outside and the powered cylinder on the inside as, in the event of a power or other failure of the actuator, persons can be locked on the inward side of the door (i.e. inside the building).

OBJECT OF THE INVENTION

It is an object of the invention to substantially overcome or at least ameliorate one or more of the above prior art disadvantages.

SUMMARY OF THE INVENTION

Accordingly, in a first aspect, the present invention provides a lock assembly adapted for use with a powered actuator, the lock assembly comprising:

a housing with at least a first axially extending recess therein;

a first barrel part within the first recess;

a torque transmitting member adapted for abutment and releasable rotational engagement with a key;

a first cam adapted to operate a lock or latch mechanism and for rotational movement with the torque transmitting member;

a drive device adapted for engagement with the powered actuator and releasable engagement with the torque transmitting member; and a spring biasing the torque transmitting member towards engagement with the drive device, and wherein the absence of a key in the first barrel part allows, the torque transmitting member to be moved by the spring into engagement with the drive device whereby pivoting movement of the drive device causes corresponding pivoting movement of the cam, and further wherein a key in the first barrel part engages and abuts the torque transmitting member and moves the torque transmitting member out of engagement with the drive device whereby pivoting movement of the key causes corresponding pivoting movement of the cam.

Preferably, in the absence of the key in the first barrel part, rotation of the drive device causes corresponding rotation of the cam, and, in the presence of the key in the first barrel part, rotation of the key causes corresponding rotation of the cam.

In a second aspect, the present invention provides a lock assembly adapted for use with a powered actuator, the lock assembly comprising:

a housing with at least a first recess axially extending therein;

a first barrel part within the recess and having a key slot;

a movable torque transmitting member substantially within the recess;

a cam adapted for rotational movement with the torque transmitting member;

a drive device adapted for engagement with the powered actuator; and a spring biasing the torque transmitting member towards the drive device;

wherein the torque transmitting member is adapted for pivoting movement with the key and independent of the drive device when a key is inserted into the key slot, and for engagement and corresponding pivoting movement with the drive device when the key is removed from the key slot.

Preferably, the torque transmitting member is adapted for rotation with the key and independent of the drive device when a key is inserted into the key slot, and for engagement and corresponding rotation with the drive device when the key is removed from the key slot.

The torque transmitting member preferably moves axially, most preferably slides, into and out of engagement with the drive device. The torque transmitting member is preferably a hollow cylinder.

The torque transmitting member preferably has a first engagement formation and the drive device preferably has a corresponding engagement formation. The torque transmitting member first engagement formation is preferably a pair of axially extending, diametrically opposed teeth and the drive device corresponding engagement formation is preferably a series of corresponding radially spaced apart recesses. The torque transmitting member teeth and the drive device recesses preferably engage as a dog clutch.

The torque transmitting member preferably has an internal flange therein, the flange adapted to abut a distal shoulder on the key. When the key is inserted in the first barrel part, the shoulder abuts the flange and moves the torque transmitting member out of engagement with the drive device, whereby the key can be rotated relative to the torque transmitting member.

The torque transmitting member internal flange preferably has a key engaging slot therein, the slot adapted to engage the distal shoulder on the key. When the key is inserted in the first barrel part in alignment with the slot, the shoulder abuts and engages the slot and moves the torque transmitting member out of engagement with the drive device, whereby rotation of the key causes corresponding rotation of the torque transmitting member.

The torque transmitting member preferably has a second engaging formation and the first cam preferably has a corresponding engagement formation. The torque transmitting member second engagement formation is preferably a pair of axially extending, diametrically opposed teeth and the first cam corresponding rear engagement formation is preferably a series of corresponding diametrically opposed recesses.

The teeth of the torque transmitting member first engagement formation are preferably about half as long as the teeth of the torque transmitting member second engagement formation.

The spring is preferably a coil spring. The coil spring is preferably positioned substantially over the first barrel part and within the torque transmitting member. The coil spring is preferably positioned between the first cam and the torque transmitting member internal flange.

The first barrel part preferably has a first portion with a first outer diameter and a second portion with a second outer diameter, less than the first outer diameter. The torque transmitting member is preferably positioned over the first barrel part second portion. The drive device is preferably positioned over the first barrel part first portion. The first barrel part preferably has a third portion with a third outer diameter less than the second outer diameter. The first cam is preferably mounted over the first barrel part third portion, and most preferably retained by a cir-clip.

The drive device preferably includes external gears. The gears are preferably adapted for engagement with a spur gear, most preferably driven by the powered actuator. The powered actuator is preferably an electric motor.

The first barrel part preferably includes a plurality, most preferably three, coding pins adapted for engagement with the housing to prevent relative rotation between the first barrel part and the housing in the absence of a correspondingly coded key in the first barrel part's key slot.

The housing preferably includes a second recess with a second barrel part rotatably mounted within the second recess, the second barrel part adapted for mounting of a second cam thereto for movement therewith. The first and second barrel parts preferably receive a key from opposed ends of the housing.

In a third aspect, the present invention provides a method of operating a powered lock assembly, the lock assembly comprising: a barrel; a torque transmitting member; a cam adapted for rotational movement with the torque transmitting member; and a torque transmitting member biased towards engagement with the drive device, the method including the steps of: inserting a key into the barrel so as to disengage the drive member from the torque transmitting member and engage the torque transmitting member with the key; and removing the key from the barrel whereby the drive member engages with the torque transmitting member.

The method preferably also includes the step of pivotally moving or rotating the torque transmitting member relative to the key after disengagement of the drive device from the cam until the torque transmitting member engages with the key.

BRIEF DESCRIPTION OF THE DRAWINGS

A preferred embodiment of the present invention will now be described, by way of an example only, with reference to the accompanying drawings wherein:

FIG. 5 is a rear view of the lock assembly shown in FIG. 6 along line 5-5 with a key fully inserted therein with the key aligned with the slot on the torque transmission member;

FIG. 6 is a cross sectional side view of the lock assembly shown in FIG. 5 along line 6-6;

DETAILED DESCRIPTION OF THE PREFERRED EMBODIMENTS

Figure 1:
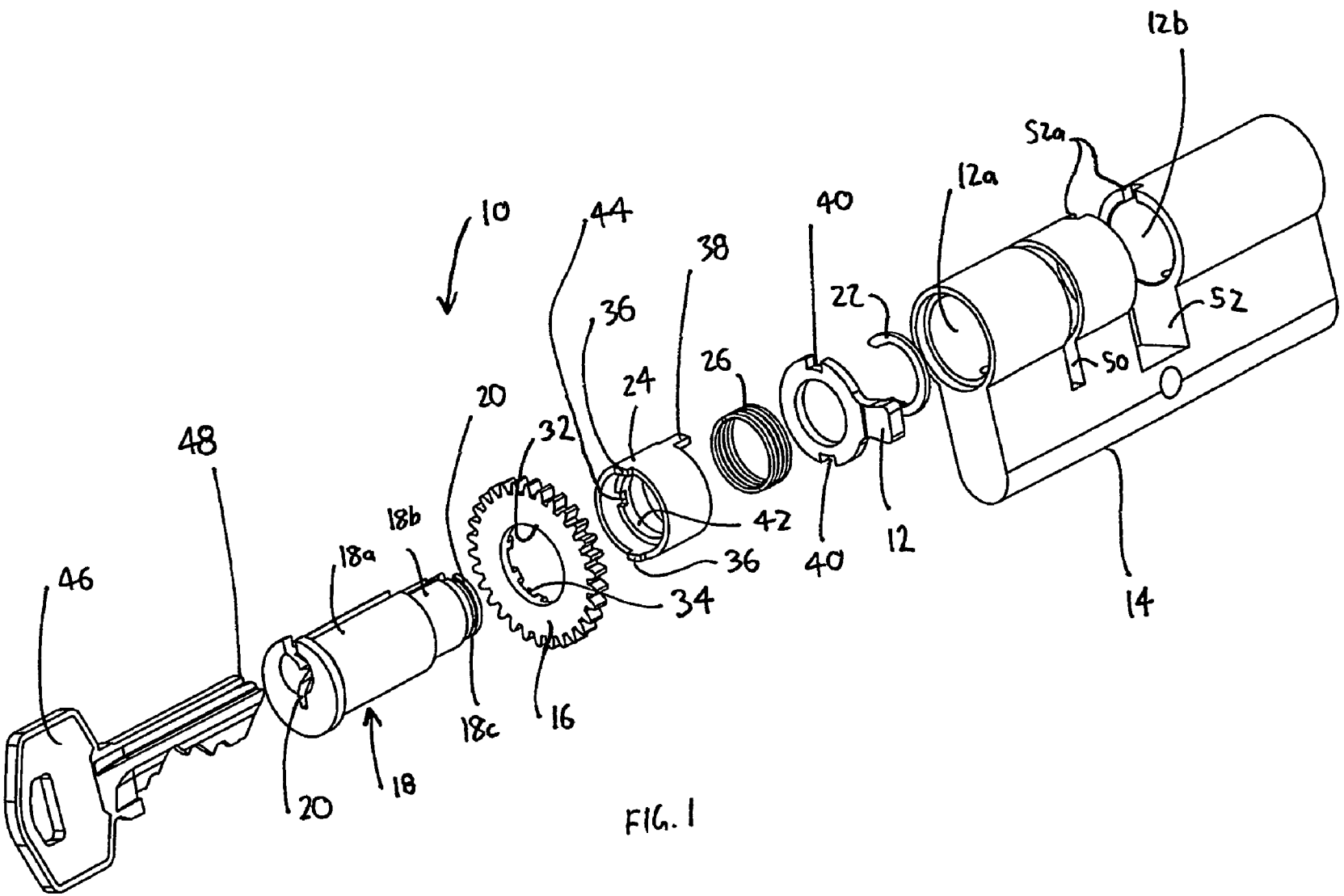
FIG. 1 is an exploded front perspective view of an embodiment of a lock assembly.
Figure 2:
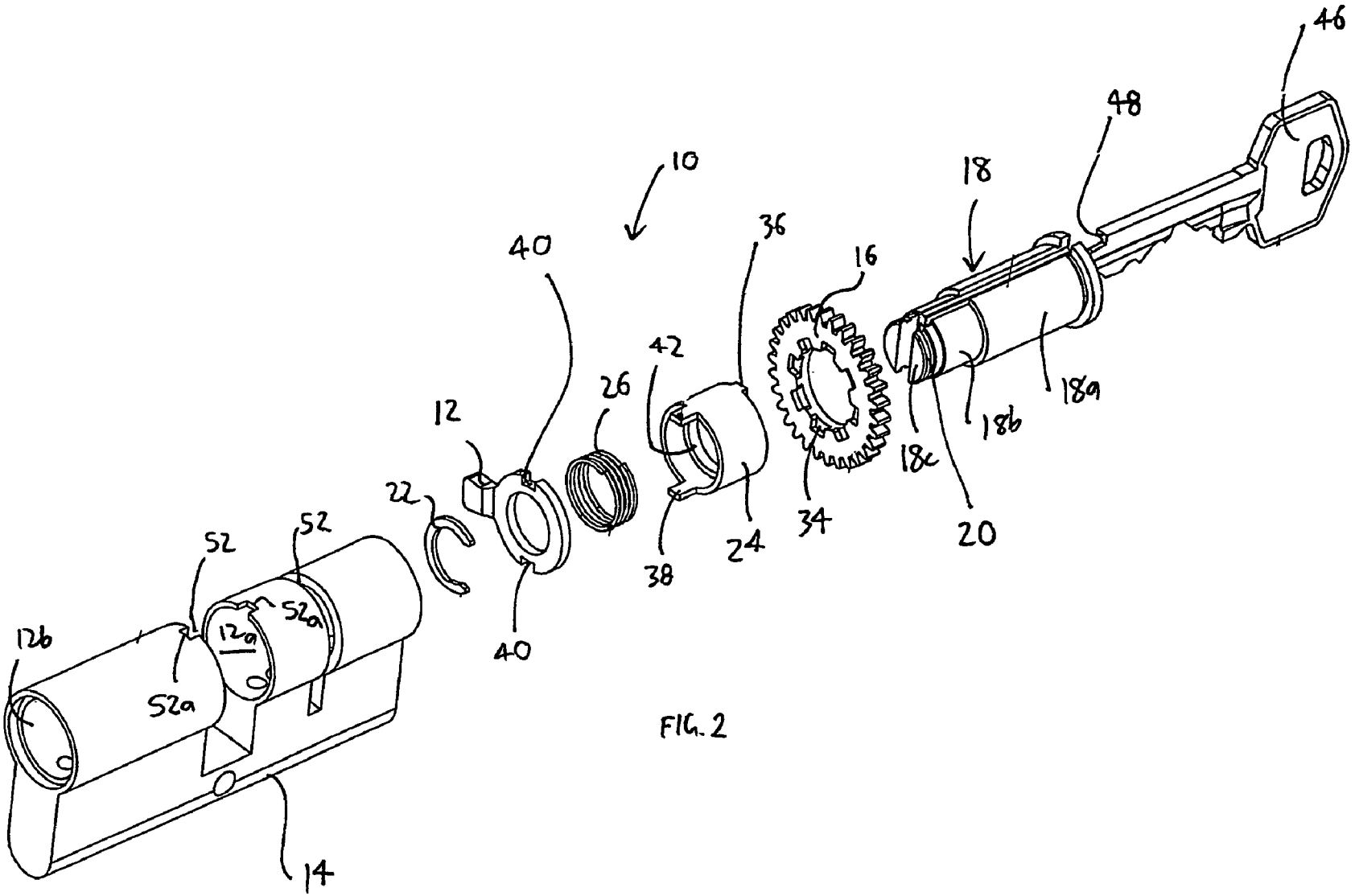
FIG. 2 is an exploded rear perspective view of the lock assembly shown in FIG. 1.

Turning firstly to FIG. 1, there is shown an embodiment of a lock assembly 10 suited for use with a powered actuator (not shown). The lock assembly 10 includes a steel cam 12 which operates a lock and latch mechanism (not shown) in a manner well understood by persons skilled in the art.

The lock assembly 10 includes a brass housing 14 having first and second spaced apart, opposed cylindrical recesses 12*a* and 12*b*.

The lock assembly 10 also includes a drive device, in the form of a steel drive gear 16, which is rotated by a spur gear (not shown) connected to an electric motor (not shown) by a gear reduction transmission (not shown).

The lock assembly 10 has a generally cylindrical, brass, first barrel part 18 in the first recess 12*a*. The barrel part 18 has a key slot 20 therein. A second barrel part (not shown) is received within the recess 12*b* and is operated only by a key in a manner well understood by persons skilled in the art.

The first barrel part 18 has a first portion 18*a* and a second portion 18*b*, the latter having a smaller outer diameter than the first portion 18*a*. The outer diameter of the first portion 18*a* of the first barrel part 18 is a rotational fit within the recess 12*a*. The first barrel part also includes a third distal end part 18*c* of further reduced diameter that contains a groove 20 for a steel cir-clip 22.

The lock assembly 10 also includes a hollow, cylindrical, steel torque transmitting member (i.e. sleeve) 24 and a steel spring 26.

Figure 4:
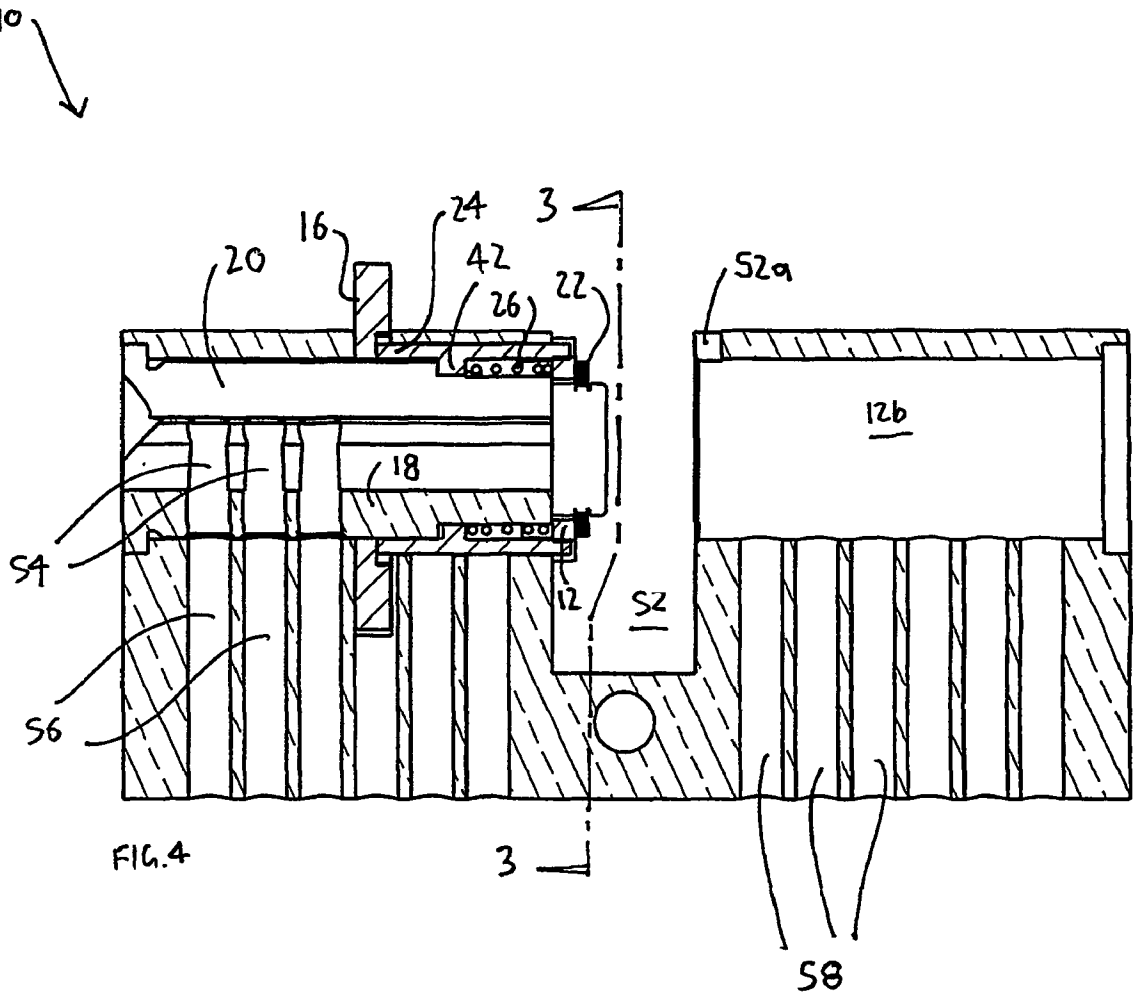
FIG. 4 is a cross sectional side view of the lock assembly shown in FIG. 3 along line 4-4.

As best shown in FIGS. 4 and 6, the gear 16 has an internal opening 32 which is a rotational fit over the first portion 18*a* of the first barrel part 18. The gear 16 also includes, on its rear side, a series of radially spaced apart recesses 34 which are sized to engage with diametrically opposed teeth 36 provided on the adjacent side of the torque transmitting member 24. The other side of the torque transmitting member 24 includes a second pair of diametrically opposed teeth 38 which are adapted to engage with a pair of corresponding diametrically opposed recesses 40 in the cam 12. The torque transmitting member 24 also includes an internal flange 42 with a key cutout or slot 44 therein. The lock assembly 10 is manually operated by a key 46, that has a distal shoulder 48 thereon, as will be described in more detail below.

The lock assembly 10 is assembled with the barrel part 18 within the recess 12*a* of the housing. The gear 16 is positioned over the first barrel part first portion 18*a*. The majority of the torque transmitting member 24 is positioned over the first barrel part rear portion 18*b*. The spring 26 is positioned within the torque transmitting member 24 on the second portion 18*b* between the internal flange 42 and the cam 12. The cam 12 is positioned over the first barrel part third portion 18*c*, and retained by the cir-clip 22.

The housing 14 includes a first (relatively small) opening 50 through which the drive gear 16 is positioned for assembly and a second (relatively larger) opening 52 through which the torque transmitting member 24 is positioned for assembly. The opening 52 includes two notches 52*a* through which the teeth 36 and 38 of the torque transmitting member 24 can pass.

The first barrel part 18 also include openings 54 for receiving 3 coding pins associated with a key having an equivalent coding, as is understood by persons skilled in the art. The coding pins interact with 3 corresponding openings 56 in the housing 12*a*, as is also understood by persons skilled in the art. The other end of the housing 14 also has openings 58 for six coding pins, which similarly interact with six openings provided in a second barrel part (not shown).

Figure 3:
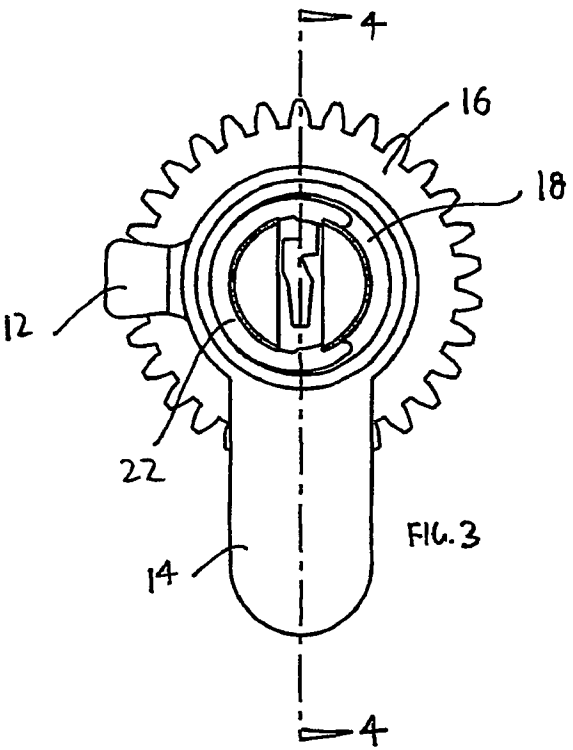
FIG. 3 is a rear view of the lock assembly shown in FIG. 4 along line 3-3 without a key inserted therein.

The operation of the lock assembly 10 shall now be described. FIGS. 3 and 4 show the lock assembly in the absence of the key 46 in the slot 20 of the first barrel part 18. As best shown in FIG. 4, the spring 26 drives the torque transmitting member 24 axially towards the gear 16. This allows the teeth 36 and recesses 34 to engage in the manner of a dog-clutch. The teeth 38 are about twice as long as the teeth 36 so they remain engaged with the recesses 40 in the cam 12 even after the torque transmitting member 24 has moved away from the cam 12 and towards the gear 16. Energising the motor pivots or rotates the gear 16 and causes corresponding pivoting movement or rotation of the cam 12, and thus operation of the associated latch and lock mechanism in response to control signals supplied to the electric motor. If the motor is energised and the teeth 36 and the recesses 34 are not aligned, then initial rotation of the gear 16 will bring them into engaging alignment with the recesses 34.

FIGS. 5 to 8 show the lock assembly with the (correct) key 46 in the first barrel part 18. The correct key 46 moves the coding pins (not shown) to permit rotation of the first barrel part 18 relative to the housing 14 in the traditional manner. In addition, the shoulder 48 on the distal end of the key 46 abuts the internal flange 42 of the torque transmitting member 24 and pushes the torque transmitting member 24 against the bias of the spring 26 away from, and out of engagement with, the gear 16.

If the slot 44 in the flange 42 is aligned with the shoulder 48 of the key 46, as shown in FIGS. 5 and 6, then the shoulder 48 enters and engages with the slot 44. As a result, rotation of the key 46 causes corresponding rotation of the torque transmitting member 24 and thus the cam 12 engaged therewith. This allows the key 46 to pivot or rotate the cam 12 without any interaction with, or resistance from, the electric motor or its gear box.

Figure 8:
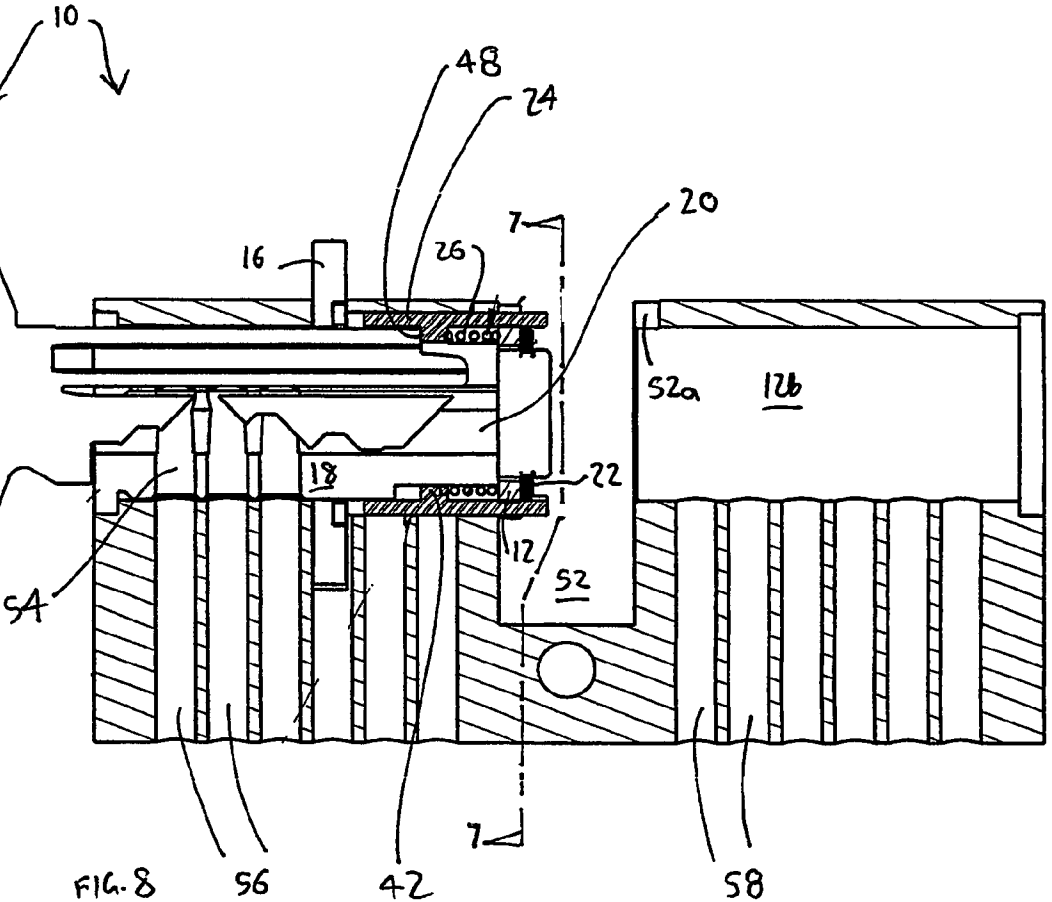
FIG. 8 is a cross sectional side view of the lock assembly shown in FIG. 7 along line 8-8.
Figure 7:
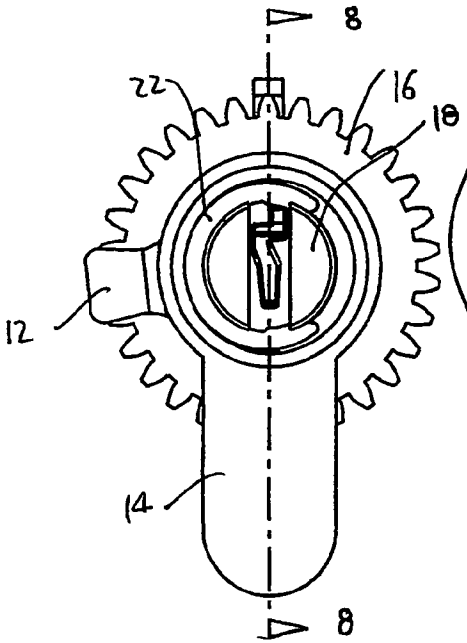
FIG. 7 is a rear view of the lock assembly shown in FIG. 8 along line 7-7 with a key fully inserted therein with the key misaligned with the slot on the torque transmission member.

If the slot 44 is not aligned with the shoulder 48 of the key 46, as shown in FIGS. 7 and 8, then the key 46 will rotate relative to the torque transmitting member 24 until such alignment (and then engagement) occurs. After alignment occurs, the torque transmitting member 24 returns to the position shown in FIGS. 5 and 6 under the influence of the spring 26.

As FIGS. 5 to 8 show, the torque transmitting member 24 is moved by the key 46 sufficiently away from the gear 16 to disengage the torque transmitting member 24 from the gear 16 regardless of whether or not the key 46 and the slot 44 are not aligned.

The lock assembly 10 is thus advantageous for installation with the powered lock cylinder positioned on the outward side of the door as, when no key is used, the lock and latch mechanism can be operated electrically, for example in response to a remote control signal or a card reader or the like. However, if there is a malfunction in the power source, control system, electric motor or gear train etc. then a key can still be used in the traditional manual manner to operate the lock and latch mechanism, even if the mechanism has stalled part way through its operation. Further, a user can advantageously also choose to use the key to operate the lock and latch mechanism without requiring the powered system to be deactivated or altered in any way.

Although the invention has been described with reference to a specific example, it would be appreciated by persons skilled in the art that the invention may be embodied in many other forms. For example, although the invention has been described in reference to a double sided lock housing having a powered lock system on one side and a traditional key cylinder on the other side, it is also suitable for use with powered cylinders on both sides of the housing given that key operation is advantageously still retained in both cylinders.

The invention claimed is:

1. A lock assembly adapted for use with a powered actuator, the lock assembly comprising:

a housing with at least a first axially extending recess therein;

a first barrel part within the first recess, the first barrel part having a first end and a second end, the first barrel part extending between the first end of the first barrel part and the second end of the first barrel part;

a torque transmitting member adapted for abutment and releasable rotational engagement with a key;

a first cam disposed around the first barrel part between the first end of the first barrel part and the second end of the first barrel part, the first cam adapted to operate a lock or latch mechanism and for rotational movement with the torque transmitting member;

a drive device disposed around the barrel part and between the first end of the first barrel part and the second end of the first barrel part, the drive device adapted for engagement with the powered actuator and releasable engagement with the torque transmitting member; and a spring biasing the torque transmitting member towards engagement with the drive device, and wherein the torque transmitting member is positioned between the drive device and the first cam and is adapted to transmit torque from the drive device to the first cam, and wherein the absence of a key in the first barrel part allows the torque transmitting member to be moved by the spring into engagement with the drive device whereby pivoting movement of the drive device causes corresponding pivoting movement of the cam, and further wherein a key in the first barrel part engages and abuts the torque transmitting member and moves the torque transmitting member out of engagement with the drive device whereby pivoting movement of the key causes corresponding pivoting movement of the cam.

2. The lock assembly as claimed in claim 1, wherein, in the absence of the key in the first barrel part, rotation of the drive device causes corresponding rotation of the cam, and, in the presence of the key in the first barrel part, rotation of the key causes corresponding rotation of the cam.

3. A lock assembly adapted for use with a powered actuator, the lock assembly comprising:

a housing with at least a first recess axially extending therein;

a first barrel part within the recess and having a key slot, the first barrel part having a first end and a second end, the first barrel part extending between the first end of the first barrel part and the second end of the first barrel part;

a movable torque transmitting member substantially within the recess;

a cam adapted for rotational movement with the torque transmitting member;

a drive device positioned within the first end of the first barrel part and the second end of the first barrel part and adapted for engagement with the powered actuator; and a spring biasing the torque transmitting member towards the drive device;

wherein the torque transmitting member is positioned between the drive device and the cam and is adapted to transmit torque from the drive device to the cam, and wherein the torque transmitting member is adapted for pivoting movement with the key and independent of the drive device when a key is inserted into the key slot, and for engagement and corresponding pivoting movement with the drive device when the key is removed from the key slot.

4. The lock assembly as claimed in claim 3, wherein the torque transmitting member is adapted for rotation with the key and independent of the drive device when a key is inserted into the key slot, and for engagement and corresponding rotation with the drive device when the key is removed from the key slot.

5. The lock assembly as claimed in claim 3, where in the torque transmitting member moves axially into and out of engagement with the drive device.

6. The lock assembly as claimed in claim 5, wherein the torque transmitting member slides axially into and out of engagement with the drive device.

7. The lock assembly as claimed in claim 3, wherein the torque transmitting member is a hollow cylinder.

8. The lock assembly as claimed in claim 3, wherein the torque transmitting member has a first engagement formation and the drive device has a corresponding engagement formation.

9. The lock assembly as claimed in claim 8, wherein the torque transmitting member first engagement formation is a pair of axially extending, diametrically opposed teeth and the drive device corresponding engagement formation is a series of corresponding radially spaced apart recesses.

10. The lock assembly as claimed in claim 9, wherein the torque transmitting member teeth and the drive device recesses engage as a dog clutch.

11. The lock assembly as claimed in claim 3, wherein the torque transmitting member has an internal flange therein, the flange adapted to abut a distal shoulder on the key, wherein, when the key is inserted in the first barrel part, the shoulder abuts the flange and moves the torque transmitting member out of engagement with the drive device, whereby the key can be rotated relative to the torque transmitting member.

12. The lock assembly as claimed in claim 11, wherein the torque transmitting member internal flange has a key engaging slot therein, the slot adapted to engage the distal shoulder on the key, wherein, when the key is inserted in the first barrel part in alignment with the slot, the shoulder abuts and engages the slot and moves the torque transmitting member out of engagement with the drive device, whereby rotation of the key causes corresponding rotation of the torque transmitting member.

13. The lock assembly as claimed in claim 12, wherein the torque transmitting member has a second engagement formation and the first cam has a corresponding engagement formation.

14. The lock assembly as claimed in claim 13, wherein the torque transmitting member second engagement formation is a pair of axially extending, diametrically opposed teeth and the first cam corresponding rear engagement formation is a series of corresponding diametrically opposed recesses.

15. The lock assembly as claimed in claim 14, wherein the teeth of the torque transmitting member first engagement formation are about half as long as the teeth of the torque transmitting member second engagement formation.

16. The lock assembly as claimed in claim 3, wherein the spring is a coil spring.

17. The lock assembly as claimed in claim 16, wherein the coil spring is positioned substantially over the first barrel part and within the torque transmitting member.

18. The lock assembly as claimed in claim 17, wherein the coil spring is positioned between the first cam and the torque transmitting member internal flange.

19. The lock assembly as claimed in claim 3, wherein the first barrel part has a first portion with a first outer diameter and a second portion with a second outer diameter, less than the first outer diameter.

20. The lock assembly as claimed in claim 19, wherein the torque transmitting member is positioned over the first barrel part second portion.

21. The lock assembly as claimed in claim 20, wherein the drive device is positioned over the first barrel part first portion.

22. The lock assembly as claimed in claim 21, wherein the first barrel part has a third portion with a third outer diameter less than the second outer diameter.

23. The lock assembly as claimed in claim 22, wherein the first cam is mounted over the first barrel part third portion, and most preferably retained by a cir-clip.

24. The lock assembly as claimed in claim 23, wherein the first cam is mounted over the first barrel part third portion, and retained by a cir-clip.

25. The lock assembly as claimed in claim 3, wherein the drive device includes external gears.

26. The lock assembly as claimed in claim 25, wherein the gears are adapted for engagement with a spur gear.

27. The lock assembly as claimed in claim 26, wherein the spur gear is driven by the powered actuator.

28. The lock assembly as claimed in claim 27, wherein the powered actuator is an electric motor.

29. The lock assembly as claimed in claim 3, wherein the first barrel part includes a plurality of coding pins adapted for engagement with the housing to prevent relative rotation between the first barrel part and the housing in the absence of a correspondingly coded key in the first barrel part's key slot.

30. The lock assembly as claimed in claim 29, wherein the first barrel part includes three said coding pins.

31. The lock assembly as claimed in claim 3, wherein the housing includes a second recess with a second barrel part rotatably mounted within the second recess, the second barrel part adapted for mounting of a second cam thereto for movement therewith.

32. The lock assembly as claimed in claim 31, wherein the first and second barrel parts receive a key from opposed ends of the housing.

* * * * *